US006378263B1

(12) United States Patent
Sobers

(10) Patent No.: US 6,378,263 B1
(45) Date of Patent: Apr. 30, 2002

(54) WALL PATCHING DEVICE

(76) Inventor: Richard K. Sobers, P.O. Box 46375, Baton Rouge, LA (US) 70895

( * ) Notice: Subject to any disclaimer, the term of this patent is extended or adjusted under 35 U.S.C. 154(b) by 0 days.

(21) Appl. No.: 09/772,049

(22) Filed: Jan. 29, 2001

(51) Int. Cl.[7] ..... E04G 23/02
(52) U.S. Cl. ..... 52/514; 52/443; 52/712
(58) Field of Search ..... 52/514, 514.5, 52/443, 712; 156/71; 428/63

(56) References Cited

U.S. PATENT DOCUMENTS

| | | | | | |
|---|---|---|---|---|---|
| 2,598,194 | A | * | 5/1952 | Shippey | 52/514 |
| 2,638,774 | A | * | 5/1953 | Wieman | 52/514 |
| 3,289,374 | A | * | 12/1966 | Metz | 52/514 |
| 3,295,285 | A | | 1/1967 | Metz | |
| 3,583,122 | A | | 6/1971 | Biegajski | |
| 3,717,970 | A | | 2/1973 | Rosenblum | |
| 3,874,505 | A | | 4/1975 | Mirarchi et al. | |
| 3,936,988 | A | | 2/1976 | Miceli | |
| 4,193,243 | A | * | 3/1980 | Tiner | 52/514 |
| 4,297,823 | A | | 11/1981 | Keisler | |
| 4,311,656 | A | * | 1/1982 | Spriggs | 52/514 X |
| 4,370,842 | A | | 2/1983 | Martin et al. | |
| 4,406,107 | A | | 9/1983 | Schoonbeck | |
| 4,460,420 | A | * | 7/1984 | Estrada | 52/514 X |
| 5,018,331 | A | | 5/1991 | Forzano | |
| 5,299,404 | A | | 4/1994 | Jabro | |
| 5,556,688 | A | | 9/1996 | Cox | |
| 5,619,836 | A | * | 4/1997 | Rouch et al. | 52/514.5 X |
| 5,687,528 | A | | 11/1997 | Rouch | |
| 5,778,624 | A | | 7/1998 | Russell | |
| 5,960,603 | A | | 10/1999 | Redden et al. | |

FOREIGN PATENT DOCUMENTS

| | | | |
|---|---|---|---|
| CA | 2172337 | 9/1997 | E04F/13/18 |

* cited by examiner

*Primary Examiner*—Laura A. Callo
(74) *Attorney, Agent, or Firm*—David L. Ray

(57) ABSTRACT

A wall patching device for attachment to the inside of a wall adjacent to a hole in the wall to fill and patch the hole. The wall patching device includes a rigid plate having a plurality of holes therein, the plate having two wings connected by a raised center portion. The raised center portion preferably has a tether connected thereto for holding the wall patching device when the wall patching device is inserted into a hole in a wall or wallboard such as a hole made by a door knob striking a wall.

20 Claims, 3 Drawing Sheets

WALL PATCHING DEVICE

BACKGROUND OF THE INVENTION

1. Field of the Invention

The present invention relates to devices for patching holes in walls. In particular the present invention relates to devices for repairing and patching holes in wall board or plaster walls.

2. Description of the Related Art

Patching holes in walls, and in particular wallboard or wall forming material such as Sheetrock®, is a common problem encountered by building owners such as homeowners, apartment owners and managers, and the like. Holes are commonly made in walls and wallboard by objects thrown in the apartment by children or tenants, or by objects tilted against the walls. Quite commonly, door knobs will strike the wall adjacent to a door causing a hole in the wall or wall board the size of a door knob.

A common way to patch a hole in a wall is to place two wood strips inside the wallboard having the hole therein across the hole. A piece of wallboard is then cut and sized to fit in the hole and attached to the wood strips to plug the hole. Common putty or adhesive joint compound sometimes referred to as mud is then applied to the hole in several layers to fill the joints around the piece of wallboard and the edges of the hole. Commonly, paper tape may be placed over the joints around the piece of wallboard placed in the hole and adhesive joint compound or putty is applied to the tape to form a smooth surface suitable for painting. One problem encountered with this patching method is that the average person such as a homeowner or other repairman rarely has scrap sheet rock or wood strips available, and these items must be purchased separately.

Patch kits for repairing holes in walls and wallboard such are commonly available. Such patch kits commonly cause a bulge in the wall after the patch is completed. Additional devices and methods for patching and repairing walls are disclosed in U.S. Pat. Nos. 3,295,285; 3,583,122; 3,717,970; 3,874,505; 3,936,988; 4,297,823; 4,370,842; 4,406,107; 5,018,331; 5,299,404; 5,556,688; 5,687,528; 5,778,624; and 5,960,603, and in Canadian Patent 2,172,337.

SUMMARY OF THE INVENTION

In accordance with the present invention there is provided a wall patching device for attachment to the inside of a wall adjacent to a hole in the wall to fill and patch the hole. The wall patching device includes a rigid plate having a plurality of holes therein, the plate having two wings connected by a raised center portion. The raised center portion preferably has a tether connected thereto for holding the wall patching device when the wall patching device is inserted into a hole in a wall or wallboard such as a hole made by a door knob striking a wall.

The wall patching device of the present invention has the advantage of being low in cost.

The wall patching device of the invention has additional advantage of enabling holes to be prepared without the necessity of utilizing small pieces of wallboard and wood strips to patch a hole in a wall.

The wall patching device of the invention has the additional advantage of being quickly and easily attached to the inside of a wall to repair a hole.

DESCRIPTION OF THE PREFERRED EMBODIMENTS

Figure 1:
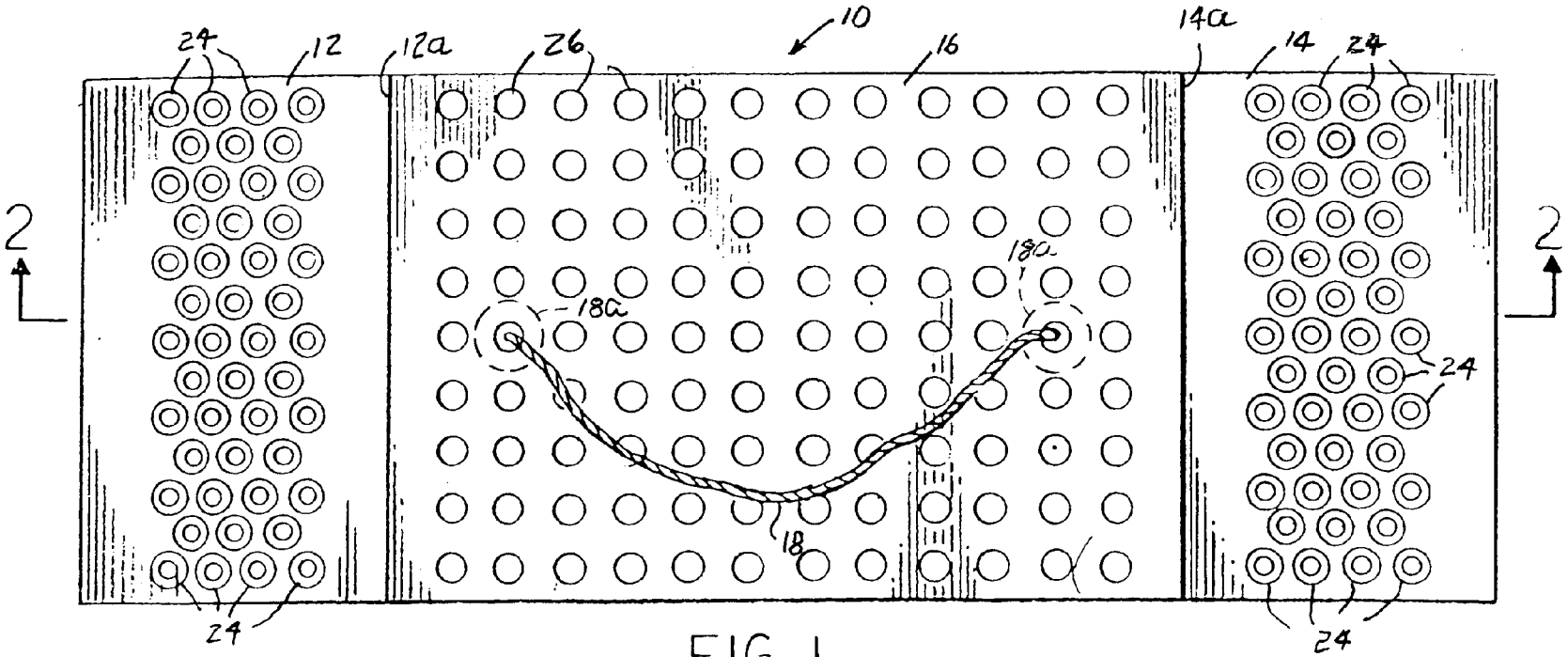
FIG. 1 is a top plan view of an embodiment of the wall patching device of the invention.
Figure 2:
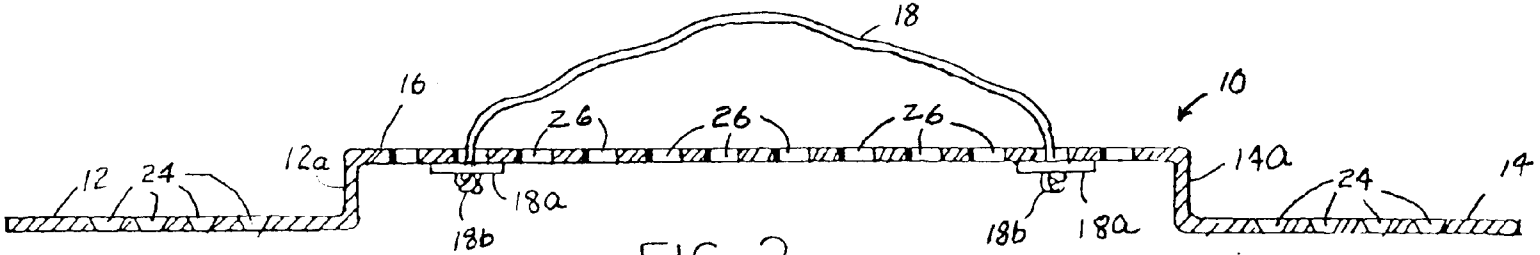
FIG. 2 is a cross sectional view taken along lines 2—2 of FIG. 1.

Referring now to FIGS. 1–5, the wall patching device of the invention is generally indicated by the numeral 10. Wall patching device 10 has two planar or flat wings 12 and 14 raised planar or flat center portion 16. Preferably, wings 12 and 14, and raised center portion 16, are generally rectangular in shape as shown in FIG. 1 and are parallel to raised center portion 16.

Wings 12 and 14 are connected to raised center portion 16 by legs 12*a* and 14*a* respectively. Preferably legs 12*a* and 14*a* are rectangular in shape. As shown in FIGS. 1–6, wings 12 and 14 are connected to the outside lower edges of legs 12*a* and 14*a*, respectively. Preferably, legs 12*a* and 14*a* are generally rectangular in shape. Legs 12*a* and 14*a* are preferably perpendicular to wings 12 and 14, respectively, and legs 12*a* and 14*a* are preferably perpendicular to raised center portion 16. Legs 12*a* and 14*a* are connected at their upper edges to two parallel opposite edges of raised center portion 16 on the underside of raised center portion 16.

Figure 5:
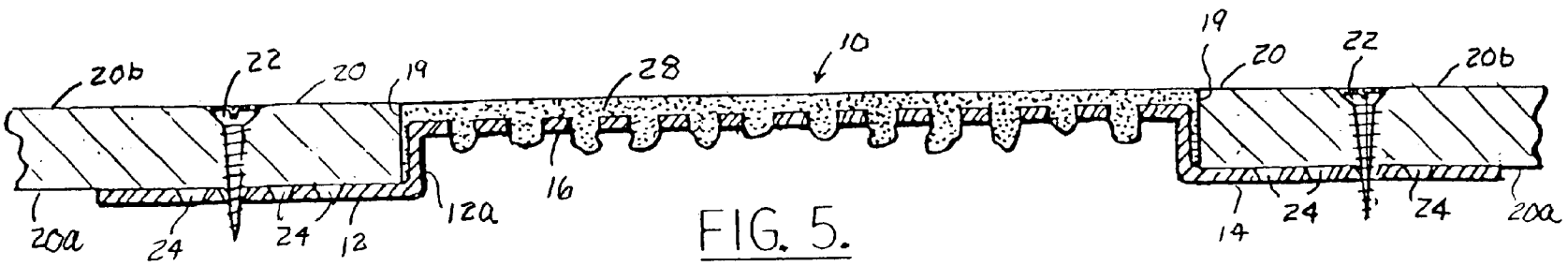
FIG. 5 is a cross sectional view taken along lines 2—2 of FIG. 1 of the wall patching device of the invention after putty or adhesive joint compound is placed thereon.

Raised center portion 16 has a plurality of holes 26 therein for receipt of putty or adhesive joint compound 28 shown in FIG. 5. Wings 12*a* and 14*a* have a plurality of downwardly tapered holes 24 therein for receipt of screws 22. Holes 24 are downwardly tapered to enable screws 24 to be more easily seated therein.

Wall patching device 10 can be made from most conventional rigid or semi-rigid material well known in the art. For example, wall patching device 10 could be made from such materials as aluminum or other metals, polymeric materials such as reinforced thermoplastic and thermosetting plastics, or any other suitable rigid or semi-rigid materials.

As shown in FIGS. 1–5, preferably raised center portion 16 has a flexible removable tether 18 connected thereto for holding wall patching device 10 when wall patching device 10 is inserted in a hole 19 in a wall 20. Tether 18 extends through two of the holes 26 in raised center portion 16 and are connected to circular washers 18*a* by tying a knot 18*b* in each of the distal ends of tether 18. Washers 18*a* are larger in outside diameter than the inside diameter of holes 26 in raised center portion 16 to anchor tether 18 thereto.

To enable a user to install wall patching device 10, the user is preferably provided with a plurality of wall patching devices of various sizes. The user selects a wall patching device 10 having a raised center portion 16 of sufficient size to substantially fill hole 19 shown in FIGS. 3, 4, and 5 in wall 20. If desired, the hole 19 may be enlarged into a rectangular shape which closely matches the size of the raised center portion 16 of the selected wall patching device 10.

Figure 3:
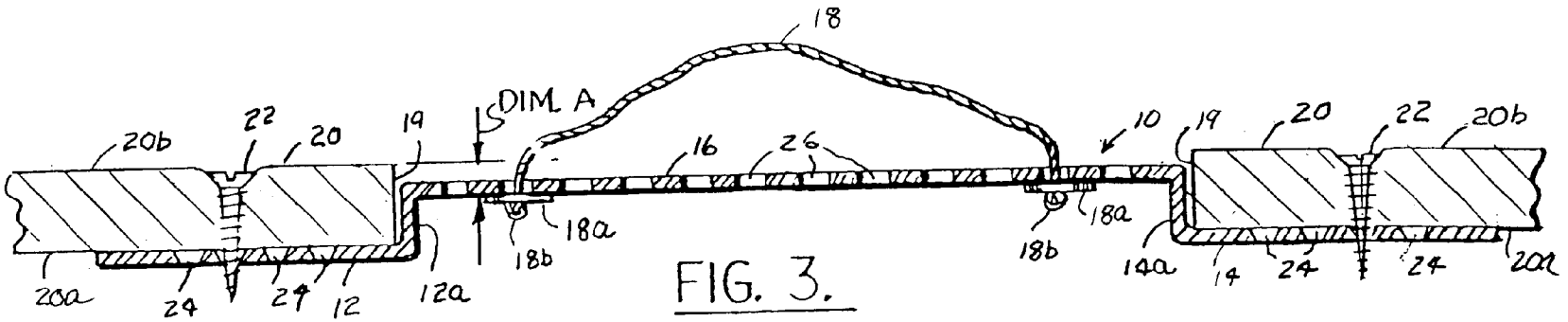
FIG. 3 is a cross sectional view taken along lines 2—2 of FIG. 1 of the wall patching device of the invention installed in a hole in the wall and having a tether connected thereto.
Figure 4:
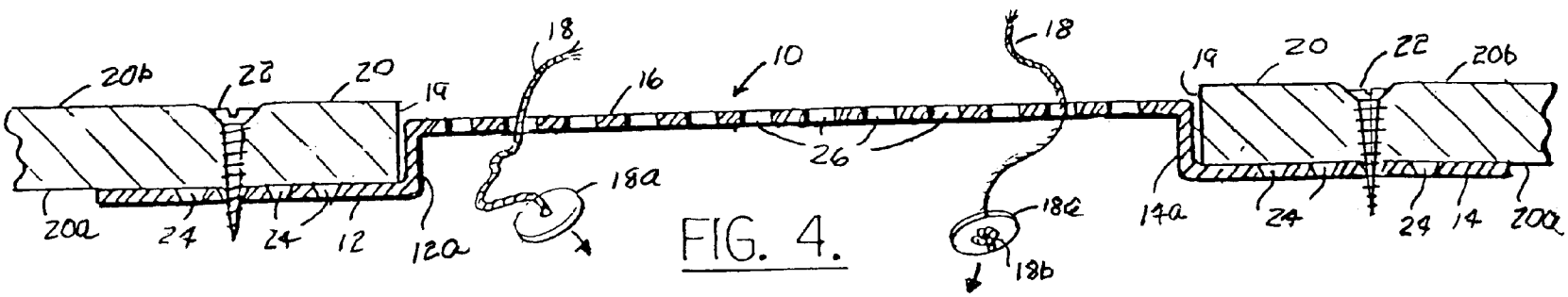
FIG. 4 is a cross sectional view taken along lines 2—2 of FIG. 1 of the wall patching device of the invention installed in a hole a wall having the tether severed.

Wall patching device 10 is then inserted into the hole 19 in wall 20, raised center portion 16 is centered in hole 19, and wings 12 and 14 are positioned behind the interior side 20*a* of wall 20 as shown in FIGS. 3 and 4, while wall patching device 10 is held in place by the user grasping tether 18. Screws 22—22 are then screwed into wall 20 while the raised center portion 16 of patching device 10 is held snugly in hole 19 by the user applying force upon tether 18. Screws 22—22 screwed into wall 20 are received in one of the plurality of tapered holes 24 in wings 12 and 14 to secure wall patching device 10 to the interior of wall 20 as shown in FIG. 3.

Preferably, the height of raised center portion 16 is selected so that the top of raised center portion 16 will be about ⅛ of an inch beneath the surface of wall 20 when wings 12 and 14 are secured to wall 20 by screws 22—22 to provide sufficient space for a layer of putty or adhesive joint compound 28 shown in FIG. 5 to be placed over raised center portion 16 to form a surface of adhesive joint compound 28 level with the exterior 20*b* of wall 20. For example, as shown in FIG. 3, dimension A (DIM. A) will be about ⅛ of an inch.

After placement of wall patching device 10 in wall 20 as shown in FIG. 3 and placement of screws 22 into and through wall 20 and into holes 24, tether 18 is cut as shown in FIG. 4, allowing tether 18 and washers 18*a* to fall from the inside of wall patching device 20 as indicated by the arrows in FIG. 4. As shown in FIG. 5, putty or adhesive joint compound 28 is placed in hole 19 over center portion 16 and is received in the plurality of holes 26 in center portion 16. The putty or adhesive joint compound 28 in hole 19 which adheres to raised center portion 16 is then smoothed level with the surface with the wall to form a patch in wall 20 which cannot be detected.

Figure 6:
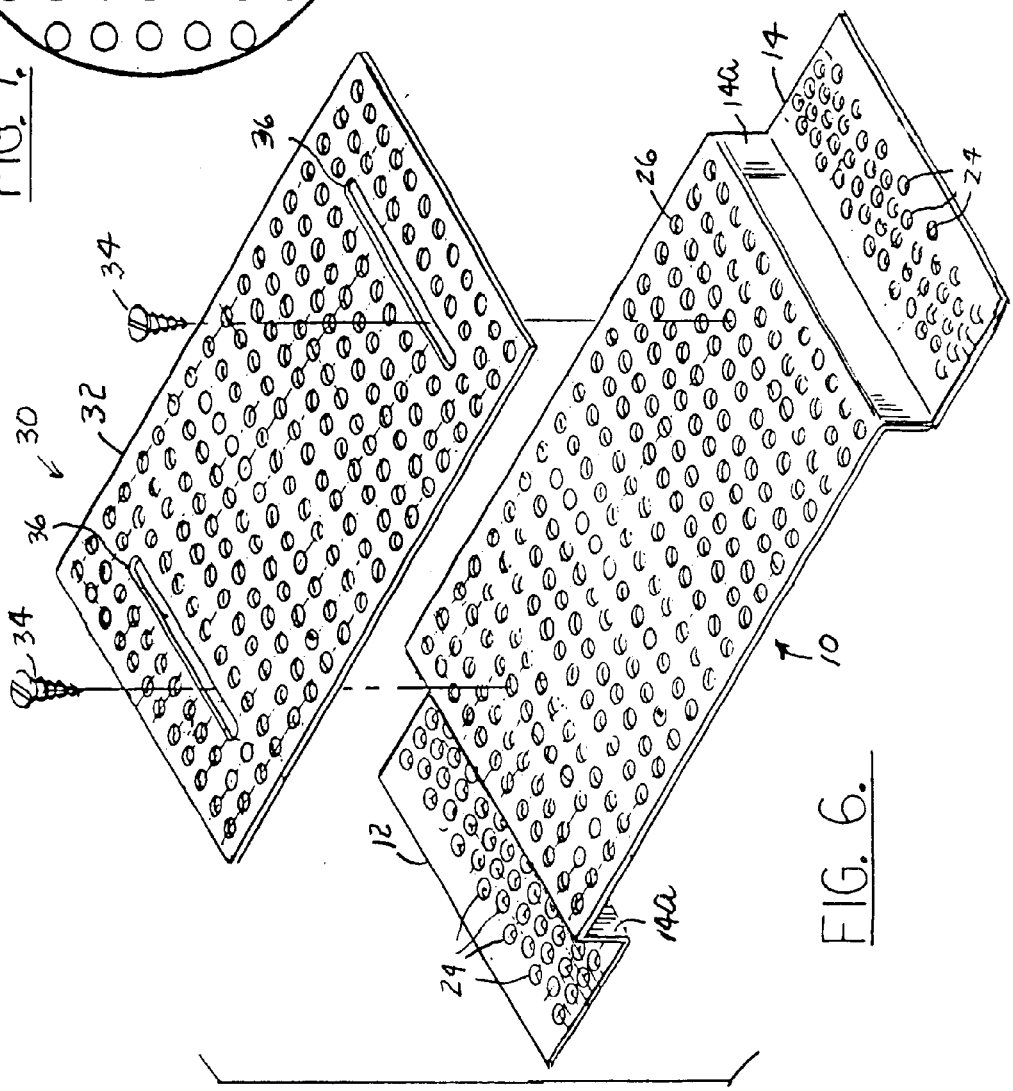
FIG. 6 is a perspective view of a second embodiment of the invention.

If desired, screws 22—22 could be deleted and wings 12 and 14 could be glued to inside of wall 20 while holding wall patching device 10 and placed in hole 19 with tether 18, although screws are preferred In FIG. 6 is shown a second embodiment of the invention generally indicated by the numeral 30. Wall patching device 10 in FIG. 6 is identical to the wall patching device shown in FIGS. 1 through 5 and preferably has tether 18 attached thereto. Embodiment 30 includes a rigid rectangular plate 32 made from the same or similar material as wall patching device 10 which is attached to the raised center portion of wall patching device 10 by screws 34 which are received in holes 26 in the raised center portion 16 of wall patching device 10. Screws 34 are received in two parallel elongated slots 36–36 in plate 32 and enable plate 32 to be moved to one side or the other of wall patching device 10 to cover a hole larger than raised center portion 16 alone. The head of each screw 34 is larger than the slots 36—36 to retain plate 30 thereon. Wall patching device 10 having plate 30 attached thereto can then be connected to the portion of a wall 20 in the same manner explained above in reference to FIGS. 3–5.

Figure 7:
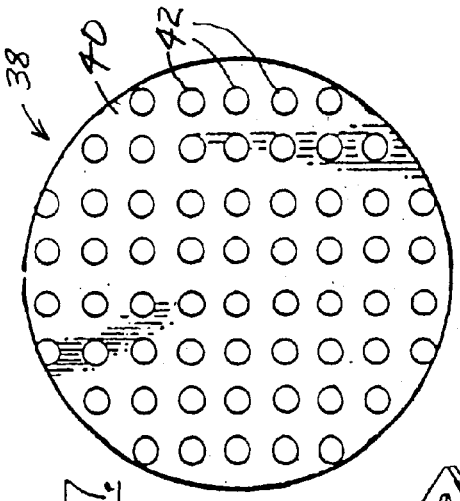
FIG. 7 is a plan view of a third embodiment of the invention.

In FIG. 7 is shown a third embodiment of the invention generally indicated by the numeral 38. Third embodiment 38 is a circular plate 40 having a plurality of holes 42 therein. A plurality of circular plates 40 of various sizes may be provided to the user to enable the user to select a plate 40 of the desired size. Third embodiment 38 is made from the same or similar material to that of wall patching device 10. Third embodiment 38 is attached to the raised center portion of wall patching device 10 by screws (not shown) which are received in holes 26 in the raised center portion 16 of wall patching device 10 to cover circular hole 19 in a wall or an irregular hole. Wall patching device 10 having plate 40 attached thereto can then be connected to the portion of a wall 20 in the same manner explained above in reference to FIGS. 3–5.

Figure 8:
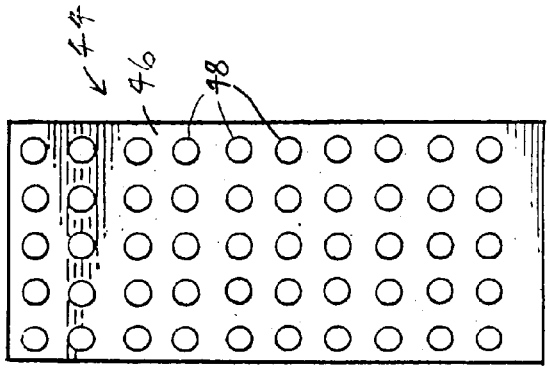
FIG. 8 is a plan view of a fourth embodiment of the invention.

In FIG. 8 is shown a fourth embodiment of the invention generally indicated by the numeral 44. Fourth embodiment 44 is a rectangular plate 46 having a plurality of holes 48 therein. A plurality of rectangular plates 44 of various sizes may be provided to the user to enable the user to select a plate 44 of the desired size. Fourth embodiment 44 is made from the same or similar material to that of wall patching device 10. Fourth embodiment 44 is attached to the raised center portion of wall patching device 10 by screws (not shown) which are received in holes 26 in the raised center portion 16 of wall patching device 10 to cover a hole 19 in a wall or an irregular hole which is wider than the raised center portion 16 of wall patching device 10. Wall patching device 10 having plate 46 attached thereto can then be connected to the portion of a wall 20 in the same manner explained above in reference to FIGS. 3–5.

Although the preferred embodiments of the invention have been described in detail above, it should be understood that the invention is in no sense limited thereby, and its scope is to be determined by that of the following claims:

What is claimed is:

1. A wall patching device for attachment to the inside of a wall adjacent to a hole in the wall to fill and patch the hole, the wall patching device comprising a rigid plate having a plurality of holes therein, said plate having two wings having a plurality of holes therein for receiving screws, a raised center portion, and two legs, each of said two legs being connected to said raised center portion and to one of said two wings, said raised center portion having a tether connected thereto for holding said wall patching device.

2. The wall patching device of claim 1 wherein said wings are identical in size.

3. The wall patching device of claim 2 wherein said wings are rectangular in shape.

4. The wall patching device of claim 3 wherein said wings are parallel to said raised center portion.

5. The wall patching device of claim 4 wherein said raised center portion is rectangular in shape.

6. The wall patching device of claim 1 wherein said legs extend perpendicularly from said raised center portion.

7. The wall patching device of claim 6 wherein said legs extend perpendicularly from the same side of said raised center portion.

8. The wall patching device of claim 7 wherein said legs are rectangular in shape.

9. The wall patching device of claim 8 wherein one of said two wings is connected to one of said two legs and the other of said two wings is connected to the other of said two legs.

10. The wall patching device of claim 9 wherein said two wings lie in same plane and are attached to the outside of said legs.

11. The wall patching device of claim 10 where said two wings are parallel to said raised center portion.

12. The wall patching device of claim 1 wherein said holes in said wings are tapered.

13. The wall patching device of claim 12 wherein said holes are circular.

14. The wall patching device of claim 1 wherein a flat plate is attached to said raised center portion by fasteners.

15. The wall patching device of claim 14 wherein said fasteners are screws.

16. The wall patching device of claim 14 wherein said flat plate has two elongated slots therein.

17. The wall patching device of claim 16 wherein said two elongated slots are parallel.

18. A wall patching device for attachment to the inside of a wall adjacent to a hole in the wall to fill and patch the hole, the wall patching device comprising a rigid plate having a plurality of holes therein, said plate having two rectangular shaped wings lying in the same plane having a plurality of holes therein for receiving screws, a raised center portion parallel to said two wings, and two parallel legs connected perpendicularly to opposite edges of said raised center portion on the same side of said raised center portion, each of said two legs having one of said two wings connected thereto, said raised center portion having a tether connected thereto for holding said wall patching device.

19. The wall patching device of claim 18 wherein said wings are identical in size.

20. The wall patching device of claim 18 wherein said wings are parallel to said raised center portion.

* * * * *